US008142163B1

(12) United States Patent
Davies

(10) Patent No.: US 8,142,163 B1
(45) Date of Patent: Mar. 27, 2012

(54) TURBINE BLADE WITH SPAR AND SHELL

(75) Inventor: Daniel O Davies, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1091 days.

(21) Appl. No.: 12/024,667

(22) Filed: Feb. 1, 2008

(51) Int. Cl.
*F01D 5/14* (2006.01)

(52) U.S. Cl. ..... 416/225; 416/92

(58) Field of Classification Search ..... 416/92, 416/223 R, 225, 226, 241 R
See application file for complete search history.

(56) References Cited

U.S. PATENT DOCUMENTS 4,314,794 A * 2/1982 Holden et al. ..... 416/97 A
4,480,956 A * 11/1984 Kruger et al. ..... 416/97 A
4,790,721 A * 12/1988 Morris et al. ..... 416/96 A
7,080,971 B2 * 7/2006 Wilson et al. ..... 416/92
7,452,189 B2 * 11/2008 Shi et al. ..... 416/226
7,670,116 B1 * 3/2010 Wilson et al. ..... 416/226
7,736,131 B1 * 6/2010 Wilson, Jr. ..... 416/226
7,758,314 B2 * 7/2010 Wilson et al. ..... 416/226
7,993,104 B1 * 8/2011 Ewing, Jr. ..... 416/226

* cited by examiner

*Primary Examiner* — Nathaniel Wiehe
(74) *Attorney, Agent, or Firm* — John Ryznic

(57) ABSTRACT

A turbine blade for use in a gas turbine engine, the turbine blade being made from a spar and shell construction in which the spar extends from the root and forms a cavity in which cooling air is supplied to the blade. The shell is held between the tip cap and the platform in grooves. A tension rod extends from the root and through the cavity within the spar to engage with the tip cap and secure the tip cap and the shell in place. A pretension nut is secured to the tension rod on the root end and engages a surface of the root to allow for a tension to be applied to the tension rod. Ceramic rope seals are secured within the grooves between the shell ends and the groove to form a seal. An inner seal is secured within a groove of the spar and engages with a projecting member on the tip cap to form a seal. Heat shields are wrapped around the platforms to provide thermal protection to the platforms.

20 Claims, 2 Drawing Sheets

TURBINE BLADE WITH SPAR AND SHELL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with a spar and shell construction.

2. Description of the Related Art Including Information Disclosed Under 37 CFR 1.97 and 1.98

In a gas turbine engine, a compressed air from a compressor is burned with a fuel in a combustor to produce a hot gas flow. The hot gas flow is passed through a multiple stage turbine to convert most of the energy from the gal flow into mechanical work to drive the compressor, and in the case of an aero engine to drive a fan, and in the case of an industrial gas turbine (IGT) engine to drive an electric generator to produce electrical power.

The efficiency of the engine can be increased by passing a higher temperature gas into the turbine, or a higher turbine inlet temperature. However, the maximum turbine inlet temperature will depend upon the material properties of the first stage turbine stator vanes and rotor blades, since these airfoils are exposed to the highest gas flow temperature. Modern engine has a turbine inlet'temperature around 2,400 degrees F., which is much higher than the melting point of a typical, modern vane or blade. These airfoils can be used under these high temperature conditions due to airfoil cooling using a mixture of convection cooling along with impingement cooling and film cooling of the internal and the external surfaces of these airfoils.

A few very high temperature materials exist that have melting points well above modern engine turbine inlet temperatures. Columbium (or Niobium) has a melt temperature of up to 4,440 F; TZM Molybdenum up to 4,750 F; hot pressed silicon nitride up to 3,500 F; Tantalum up to 5,400 F; and Tungsten up to 6,150 F. these materials would allow for higher turbine inlet temperatures. However, these materials cannot be cast or machined to form turbine airfoils.

On prior art method of forming a turbine airfoil from one of these exotic high temperature materials is disclosed in U.S. Pat. No. 7,080,971 B2 issued to Wilson et al on Jul. 25, 2006 and entitled COOLED TURBINE SPAR SHELL BLADE CONSTRUCTION, the entire disclosure being incorporated herein by reference. The shell is formed from a wire EDM process to form a thin walled airfoil shell, and the shell is held in compression between a spar tip and the blade platform or root section. The shell can take the higher gas flow temperatures, and the spar provides internal cooling for the airfoil walls.

Part life is another important factor in the engine, especially for an industrial gas turbine (IGT) engine. In a spar and shell turbine blade, the spar is held in place between the blade platform or root section and the spar tip. The shell in the Wilson et al (U.S. Pat. No. 7,080,971) would be placed under a compressive load due to the centrifugal force acting to push the shell in the blade radial outward direction and up against the underside of the spar tip edge. Operating the shell of the turbine blade with, a spar and shell construction is better than operating the shell under a tensile loading because the tensile loads will have a shorter life than one under a compressive loading. Operating the shell under near zero loading would allow for an infinite life for this part since the part would be operating under practically no loading. Except for the thermal loading and pressure loading from the hot gas flow reacting onto the shell surface, the turbine blade could be used for an indefinite period of time.

BRIEF SUMMARY OF THE INVENTION

It is an object of the present invention to provide for a turbine airfoil with a very long life prediction for the shell.

It is another object of the present invention to provide for a shell formed from a wire EDM process.

It is another object of the present invention to provide for a spar and shell turbine blade in which the shell is supported in compression to increase the life and allow for CMC, micro porous TBC coating, and silicon nitride.

It is another object of the present invention to provide for a spar and shell turbine blade with a thermally free platform to relieve thermal fight.

It is another object of the present invention to provide for a spar and shell turbine blade which eliminates bonds, welds and brazes.

It is another object of the present invention to provide for a spar and shell turbine blade with a much lighter weight.

It is another object of the present invention to provide for a spar and shell turbine blade, in which the spar is unloaded by the shell or the tip cap.

The present invention is a turbine blade with a spar and shell construction. The spar extends from the blade platform section and includes a hollow interior. The shell is held in place between the platform and a blade tip cap. A tension rod extends from the blade root through the hollow spar and engages with the tip cap such that the spar is unloaded from the shell or the tip cap. The tip cap and the platform include grooves in which the shell ends fit. A ceramic seal fits within the grooves between the shell tip and the bottom of the groove within the tip cap and the platform and creates a seal for the shell. A pretension nut is threaded to the root end of the tension rod to provide a predetermined tension to the tension rod to load the shell within the blade assembly.

With the blade assembly of the present invention, the shell can be made from a high temperature resistant material such as Molybdenum. Also, the loads formed on the shell and the tip cap from rotation of the blade assembly will not be passed onto the spar but through the tension rod.

DETAILED DESCRIPTION OF THE INVENTION

Figure 1:
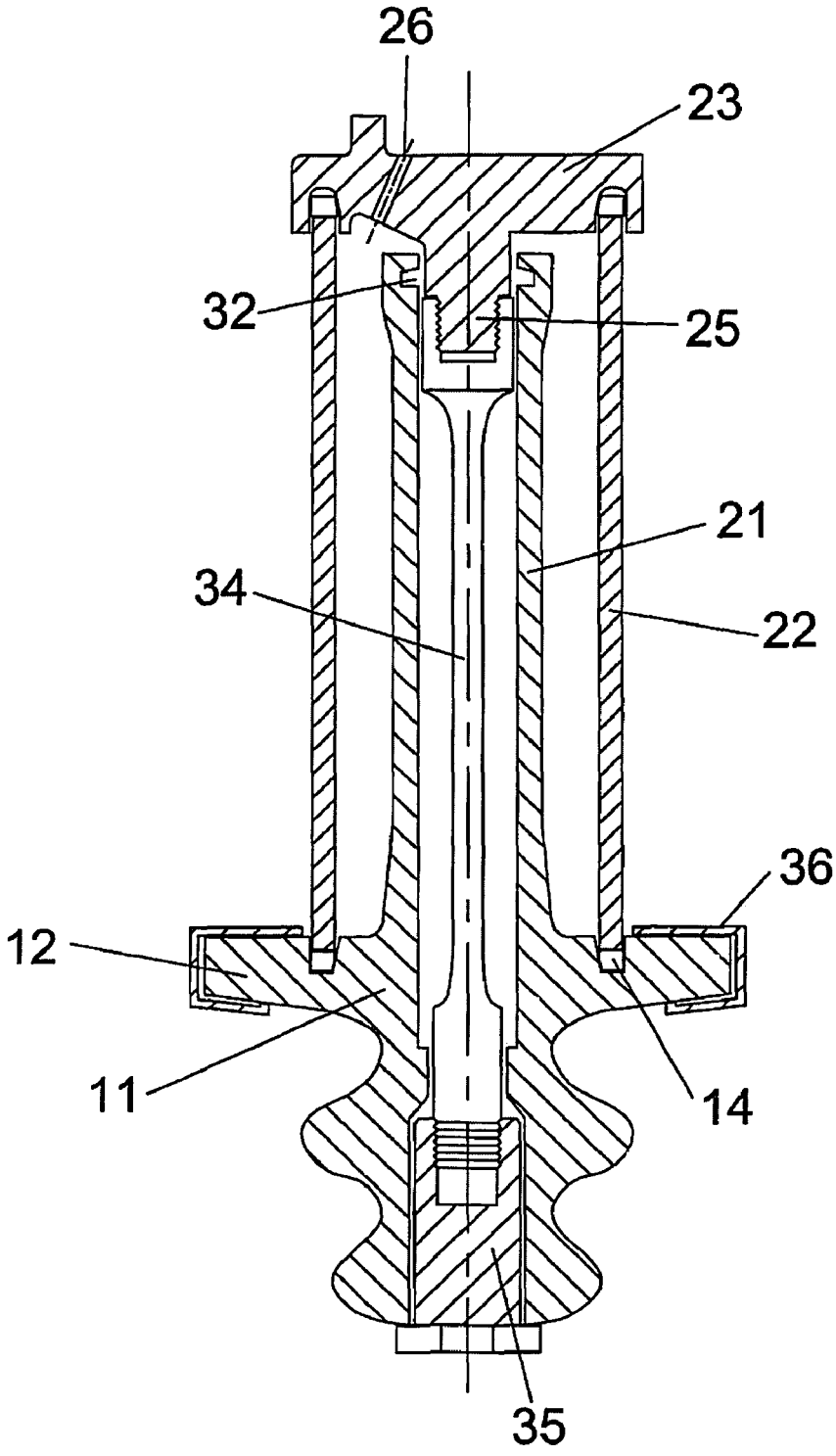
FIG. 1 is a cross section side view of the blade assembly of the present invention.

The present invention is a turbine blade with a spar and shell construction that reduces or eliminates the problems discussed above in the background. The blade 10 is shown in FIG. 1 and includes a root section 11 with a platform 12 extending outwards to form the hot gas flow path, the root 11 also including a fir tree configuration or other slot engagement formation in which the blade assembly is inserted into a rotor disk slot. A groove 14 is formed in the platform surface to receive the airfoil shaped shell described below. A spar 21 extends from the root section 11 and is of the same piece as the root 11 and platform 12. The spar 21 is hollow inside to allow for a supply of cooling air to the blade and for the insertion of a tension rod to be described below. The root 11, platform 12 and spar 21 are formed as a single piece, preferably from, an investment casting process using a super-alloy such as nickel super-alloys or other prior art investment cast materials used to form turbine airfoils. A preferred material for the spar 21 is CM247.

A shell 22 is secured between a tip cap 23 and the platform 12 as seen in FIG. 1. The shell 21 is made from a material that cannot be cast or machined using prior art forming processes, and is made from a very high temperature resistant material that can be formed from a process such as a straight line wire EDM process. The shell is a thin walled surface that forms the airfoil portion of the blade and includes the leading edge and the trailing edge, and the pressure side and the suction side walls. The shell thickness about 0.060 inches. The shell 21 is held in compression during engine operation between the spar tip 12 and the platform 31. If the shell is made from molybdenum, it is predicted that the thermal stress parameter will be improved by more than four times over the prior art single crystal turbine blade (PWA-1483). The use of Columbium for the shell will improve the thermal stress parameter three times. The shell can also be made from single crystal material.

Figure 3:
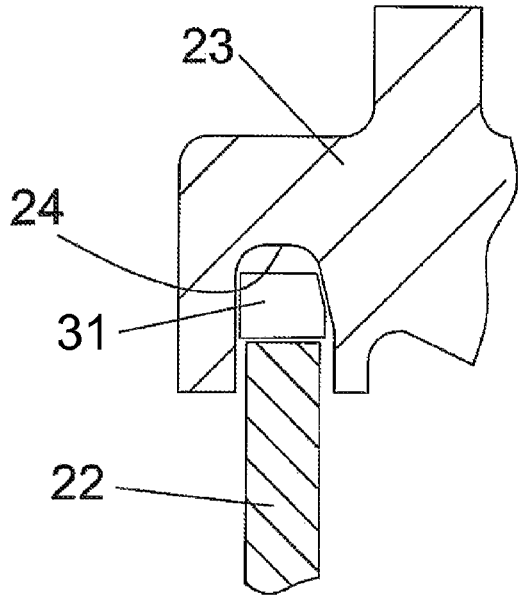
FIG. 3 shows a detailed view of the shell and tip cap connection with a ceramic seal in the blade of the present invention.

A tip cap 23 is secured to the tip of the blade assembly and secures the shell to the platform 12. The tip cap is formed from a high temperature resistant material like that, of the spar and root 11, or it can be made from a single crystal material. The tip cap 23 includes a groove 24 that extends around the tip cap and has the form of the airfoil shaped shell. The tip cap 23 includes a threaded projecting member that extends toward the platform. A ceramic seal 31 is pinched between the shell 22 end and the bottom of the groove 24 in the tip cap 23 as seen in the detailed view of FIG. 3. An additional seal 32 is secured within a groove formed on the inner surface and the top end of the spar to form a seal between the inner surface of the spar 21 and the tip cap projecting member 25. The tip cap can include one or more tip cooling holes 26 to discharge cooling air from the spar cavity and out through the tip cap 23. The tip cap can also include a squealer tip formation to provide for improved rubbing capability.

A tension rod 34 is used to secure the tip cap 23 and the shell 22 to root 11. The tension rod 34 includes a tip end with a threaded female opening that engages similar threads formed on the tip cap projecting member 25. The tension rod 34 may also be integral with, and of the same material as, the tip cap 23. The tension rod 34 includes a platform or root end with a male threaded outer surface. With the tip cap 23 and shell 22 positioned in place to form the blade assembly, the tension rod 34 is placed through an opening on the bottom of the root 11 and into the hollow section of the spar and threaded onto the male threads on the tip cap projecting member 25. The seals are placed within the proper grooves before the tip cap and shell are, positioned in place. A pretension nut 35 having a cavity with threads on one end and a bolt head on the opposite end is threaded onto the male threads of the tension rod to produce a tension on the tension rod 34 and therefore a compressive load on the shell 22 through the tip cap 23. The tension rod 34 can be made from Inconel 718 or other similar high strength materials.

Ceramic rope seals are placed in grooves formed on the platform 12 and the underside of the tip cap 23 to form a seal between the ends of the shell 22 and the platform and tip cap. Ceramic seals are used because this material is resistant to the very high temperatures of the gas flow.

The dissimilar metal joint formed between the tip cap projecting member 25 and the tension rod 34 can be machine threads, a forged bond, a ball and socket, or other well known engagement means.

Figure 2:
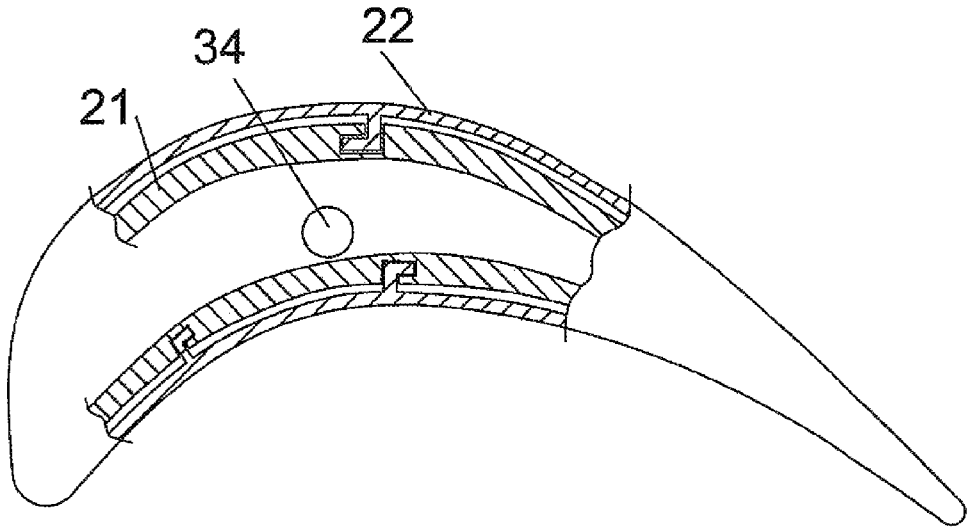
FIG. 2 shows a cross section top view of the spar and shell connection of the blade of FIG. 1 in the present invention.

FIG. 2 shows a cross section top view of the interface between the shell 22 and the spar 21. The shell 22 includes a hook extending along the inner surface from one end to the opposite end. An L-shaped groove is formed within the outer wall surface of the spar 21 to receive the hook. Hooks are located, on both the pressure side and the suction side of the shell 22 and function to prevent displacement of the shell 22 from, the spar 21 during engine operation. The number of hooks used can vary depending on the flexibility of the shell. The spar 21 includes a hollow interior cavity which the tension rod 34 extends through. The spar cavity also forms a cooling supply channel that connects one or more cooling air supply passages formed in the root 1 to the airfoil interior. The spar 21 can also include impingement air cooling holes positioned at desired locations to provide impingement cooling air to the inner wall of the shell 22. The shell 22 would require a row of exit cooling holes along the trailing edge region to discharge the spent impingement cooling air from the airfoil.

The platforms 12 can include a C-shaped heat shield 36 to provide additional thermal protection to the platforms of the blade. The heat shields 36 are formed Molybdenum or other high temperature resistant materials in which the shell is formed from. The heat shields 36 would extend to the shell wall surface to prevent the hot gas flow from contacting the platform 12.

Because the shell 22 is held under compression during engine operation, an infinite life for the shell is predicted. Thus, the turbine blade 10 with the spar and shell construction of the present invention can be used in an engine, such as an industrial gas turbine engine, for long periods without repair or replacement. Also, because the shell is held in compression (instead of tension in the solid blades of the prior art), the blade with a TBC applied will not spill (TBC chips off from the surface) as much and therefore will have a longer service life as well. The blade also eliminates the need for bonds, welds and brazes so that only a mechanical attachment is needed.

Another benefit from the turbine blade with the spar and shell construction of the present invention is the weight savings over the prior art blade. A large IGT engine used for power production includes 72 blades in the first stage of the turbine, and each blade weighs 14.7 pounds including the TBC. The blade of the present invention weighs about 11 pounds which is almost 4 pounds less than the prior art. A lighter blade will produce lower stresses on the rotor disk due to the centrifugal forces developed. Lower stress on the rotor disk will allow for smaller and less weight rotor disks, or improved disk LCF life at the life limiting location.

Another feature of the spar and shell turbine blade of the present invention is the reduction in the casting technology used to form the blade. A lower level of casting technology allows for alternative casting vendors to be used to manufacture the blade. The present invention provides approximately 30% reduction is size of casting footprint. Casting costs are a function of parts per mold, and casting yield. Removing the platform would allow more parts per mold for airfoil spar and increased yield. Separate platform would permit (if cast) cored platforms and other high technology features to be used.

I claim:

1. A turbine blade comprising:

a root with a platform;

a spar extending from the root, the spar having a cavity extending along the entire spar;

a shell having an airfoil shape with a leading and trailing edge and a pressure side and a suction side extending between the two edges;

a tip cap with a tension rod engaging means extending from the underside;

a tension rod secured to the tension rod engaging means on one end and secured to the root on the opposite end; and, the shell being secured between the platform and the tip cap when the tension rod is under tension.

2. The turbine blade of claim 1, and further comprising:

the tip cap includes a groove formed on the tip cap underside; and, the shell being secured to the tip cap within the tip cap groove.

3. The turbine blade of claim 2, and further comprising:

a seal secured within the tip cap groove between the groove and the shell end.

4. The turbine blade of claim 3, and further comprising:

the tip cap seal is a ceramic rope seal.

5. The turbine blade of claim 2, and further comprising:

the tip cap groove includes a side wall having a slope such that the seal is forced against the two side walls of the groove as the shell pushes on the seal.

6. The turbine blade of claim 1, and further comprising:

the tip cap is formed form Molybdenum.

7. The turbine blade of claim 1, and further comprising:

the tip cap includes a cooling air exit hole to discharge cooling air out through the tip cap.

8. The turbine blade of claim 1, and further comprising:

the tip cap includes a tip rail; and, the tip cap includes a cooling air exit hole on a downstream side of the tip rail in the direction of the hot gas flow to discharge cooling air out through the tip cap.

9. The turbine blade of claim 1, and further comprising:

a pretension nut to engage with the tension rod at the root end, the pretension nut having a surface to abut against the root such that a tension can be applied to the tension rod.

10. The turbine blade of claim 1, and further comprising:

the tension rod extends through the cavity formed within the spar.

11. The turbine blade of claim 1, and further comprising:

the root and the spar are formed of a single piece.

12. The turbine blade of claim 1, and further comprising:

the root, the platform and the spar are formed of a single piece.

13. The turbine blade of claim 1, and further comprising:

the spar includes a plurality of impingement cooling holes arranged to discharge impingement cooling air onto the backside surface of the shell.

14. The turbine blade of claim 1, and further comprising:

the spar and the tip cap include a seal secured within a groove formed in at least one of the spar and the tip cap to provide a seal between the tip cap and the spar tip end.

15. The turbine blade of claim 1, and further comprising:

a heat shield extending around the platform to provide for thermal protection from the hot gas flow.

16. The turbine blade of claim 1, and further comprising:

the tension rod is formed from Inconel 718.

17. The turbine blade of claim 1, and further comprising:

a platform groove extending around the platform and having a cross sectional shape of the shell airfoil; and, the shell secured within the platform groove.

18. The turbine blade of claim 17, and further comprising:

a seal secured within the platform groove between the groove and the shell end.

19. The turbine blade of claim 18, and further comprising:

the platform seal is a ceramic rope seal.

20. The turbine blade of claim 1, and further comprising:

the tip cap includes a first projecting portion and a second projecting portion having a smaller diameter than the first projecting portion;

the first projecting portion forming a sealing surface for a seal positioned between the spar and the tip cap; and, the second projecting portion having an engagement surface to engage with the tension rod.

* * * * *